US005155291A

United States Patent [19]

Dabrowski

[11] Patent Number: 5,155,291

[45] Date of Patent: Oct. 13, 1992

[54] BARREL ASSEMBLY FOR HOME SECURITY WEAPON

[75] Inventor: Gary P. Dabrowski, Naugatuck, Conn.

[73] Assignee: O. F. Mossberg & Sons Inc., North Haven, Conn.

[21] Appl. No.: 782,320

[22] Filed: Oct. 24, 1991

[51] Int. Cl.[5] ..... F41A 21/40

[52] U.S. Cl. ..... 89/14.05; 42/79; 42/78

[58] Field of Search ..... 89/14.05, 14.3, 14.4, 89/15, 16; 42/75.02, 75.04, 76.01, 76.02, 78, 79

[56] References Cited

U.S. PATENT DOCUMENTS

| | | | |
|---|---|---|---|
| 1,636,357 | 7/1927 | Cutts | 89/14.3 |
| 2,323,306 | 7/1943 | Campbell | 42/76.01 |
| 3,226,871 | 1/1966 | Sargeant et al. | 42/76.01 |
| 3,284,942 | 11/1966 | Moseley | 89/14.3 |
| 3,676,947 | 7/1972 | Ashbrook et al. | 42/79 |
| 4,722,261 | 2/1988 | Titus | 89/14.05 |

FOREIGN PATENT DOCUMENTS

| | | | |
|---|---|---|---|
| 1053288 | 3/1959 | Fed. Rep. of Germany | 42/78 |
| 349103 | 5/1905 | France | 42/78 |
| 1360390 | 3/1964 | France | 89/14.3 |
| 82613 | 10/1919 | Switzerland | 42/76.01 |

*Primary Examiner*—Stephen M. Johnson
*Attorney, Agent, or Firm*—McCormick, Paulding & Huber

[57] ABSTRACT

A shotgun barrel assembly for producing a prematurely enlarged shot pattern has an axially position on barrel and a barrel extension mounted in fixed position on the forward end of the barrel. The barrel defines a shell chamber and a bore which communicates with and extends forwardly of the shell chamber and opens through the forward end of the barrel. A portion of the bore forward of the shell chamber is generally cylindrical and terminates at a conically tapered forwardly diverging portion which opens through the forward end of the barrel and has an axial length at least equal to eight times the diameter of the cylindrical portion. The barrel extension defines an expansion portion which forms an extension of the bore and which has a diameter greater than the major diameter of the conically tapered portion. Compensating slots may be formed in the barrel extension portion.

15 Claims, 1 Drawing Sheet

BARREL ASSEMBLY FOR HOME SECURITY WEAPON

BACKGROUND OF THE INVENTION

This invention relates in general to firearms and deals more particularly with an improved barrel assembly for a shotgun particularly adapted for use as a home security weapon.

A shotgun, as opposed to a handgun, is an ideal home security weapon. The potentially devastating effect of a shotgun fired at close range is generally well known. Consequently, the mere brandishing of such a weapon will usually be sufficient to deter most intruders. One familiar with safe gun handling procedure may quickly become proficient in pointing a shotgun at a close range target, which makes such a weapon an ideal choice as a home security weapon by a person lacking the time or inclination to develop the marksmanship skill essential to the proper handling of a handgun.

A round of handgun ammunition having sufficient potential impact energy to stop an advancing assailant will easily penetrate the wall of an average residential building posing a threat to innocent persons outside of the building. However, the individual pellets which comprise a shotgun charge generally lack the impact energy necessary to pass through the wall of such a building.

The 410 gauge shotgun is particularly well suited for use as a home security weapon, because it is convenient for the average person to handle and is not too large to be comfortably handled by a person of small stature. A 410 gauge shotgun shell fired at close range has substantially greater impact energy than a 9 mm round of ammunition and will produce a shot pattern approximately 4 to 6 inches in diameter at a range of 10 to 14 feet. Should it become necessary to fire the weapon in self-defense, even a poorly directed shot striking a soft tissue target should produce sufficient shock and trauma to halt an advancing armed assailant.

It is the general aim of the present invention to provide an improved shotgun barrel assembly which provides a prematurely opening shot pattern to increase the close range hit probability of such a gun, thereby reducing likelihood that a close range shot will be wholly misdirected, even when fired under the most stressful conditions.

SUMMARY OF THE INVENTION

In accordance with the present invention a shotgun barrel assembly comprises an axially elongate barrel having a shell chamber and an axially forwardly extending bore coaxially aligned and communicating with the shell chamber and opening through the forward end of the barrel. The bore has a generally cylindrical portion extending forwardly from the shell chamber and further includes a conically tapered forwardly diverging portion extending from the forward end of the cylindrical portion and opening through the forward end of the barrel. The conical tapered portion has an axial length at least equal to at eight times the diameter of the cylindrical portion.

DETAILED DESCRIPTION OF PREFERRED EMBODIMENT

Figure 1:
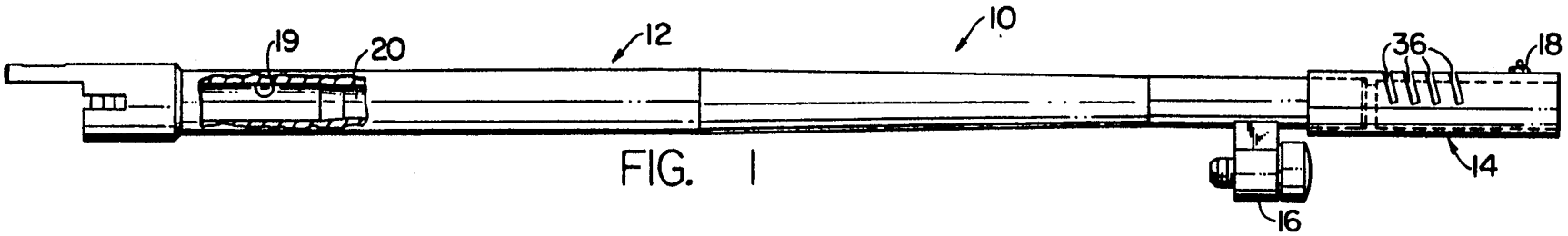
FIG. 1 is a side elevational view of a barrel assembly embodying the present invention.

Turning now to the drawing, a barrel assembly embodying the present invention is indicated generally by the reference numeral 10. The illustrated barrel assembly 10 forms part of a MOSSBERG Model 500E 410 gauge shotgun manufactured and marketed by O. F. Mossberg & Sons, Inc., North Haven, Conn., 06473, assignee of the present invention, and essentially comprises an axially elongate barrel, indicated generally at 12, and a barrel extension, designated generally by the numeral 14, attached in fixed position to the forward or front end of the barrel and defining the muzzle of the barrel assembly. The illustrated assembly 10 also includes a conventional take down screw assembly 16 depending from the forward end of the barrel 12, and a front sight 18 mounted on the barrel extension 14, substantially as shown.

Figure 2:
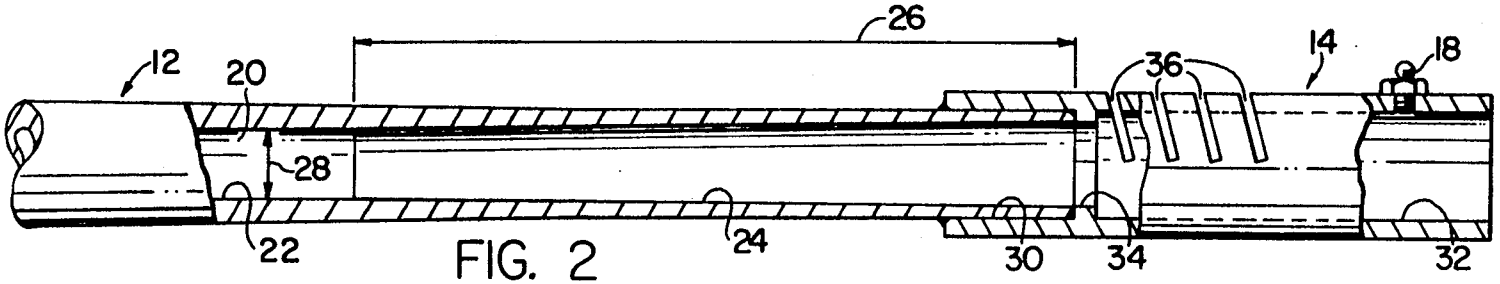
FIG. 2 is a somewhat enlarged fragmentary view of the barrel assembly of FIG. 1 shown partially in axial section.

The barrel 12 is an interchangeable type barrel adapted to be releasably secured to the action assembly or receiver of an associated shotgun and has a conventional generally cylindrical shell chamber 19 at its rear end and a smooth coaxial bore 20 which communicates with the shell chamber and extends from the chamber throughout the length of the barrel and opens through the forward end of the barrel. The bore has a cylindrical portion 22 of extensive length, which communicates at its rear end with the shell chamber, and further includes a forwardly diverging conically tapered portion 24 which extends from the forward end of the cylindrical portion 22 to the forward end of the barrel 12. The conically tapered portion has an axial length indicated by the numeral 26 which is at least equal to eight times the diameter of the cylindrical portion 22, the latter diameter being indicated by the numeral 28 in FIG. 2. However, in accordance with the presently preferred construction the length dimension 26 is substantially equal to ten times the diameter dimension 28. Preferably, the conically tapered portion 24 has a taper of 0.250 inches per foot (2.08 cm/m).

The barrel extension 14 comprises a substantially tubular member soldered or otherwise secured in fixed position to the forward end of the barrel. The illustrated barrel extension 14 has a generally cylindrical rearwardly open barrel receiving bore 30 which has an inside diameter substantially equal to the outside diameter of the forward end of the barrel.

The tubular barrel extension 14 defines a generally cylindrical diametrically enlarged expansion portion 32 which forms a forward extension of the bore 20. The expansion portion 32 has a diameter substantially larger than the major diameter of the conically tapered portion 24, that is a diameter larger than the diameter of the conically tapered portion as measured at the forward end of the barrel 12. An integral annular radially inwardly directed transition portion 34 disposed between the cylindrical barrel receiving portion 30 and the expansion portion 32 has an inside diameter substantially equal to the major diameter of the conically tapered portion.

A plurality of compensating slots 36, 36 are or may be formed in the tubular barrel extension 14, substantially as shown. The illustrated slots 36, 36 comprises upwardly and rearwardly inclined slots which communicate with the expansion portion 32 and with the atmosphere and are preferably disposed wholly to one side of an axial plane of the bore 20.

When a shotgun shell is discharged within the chamber the wad and shot column, which comprise part of the shell, accelerate through the cylindrical portion 22 propelled by the gases of explosion produced-by the burning of the propellent within the shell. As the shot column and wad enter and travel through the diverging conical portion 24 some radial expansion of the shot column occurs. Gases of explosion escape past the wad causing turbulence near the outer periphery of the radially expanding shot column. When the shot column leaves the barrel 12 and enters the barrel extension 14 the abrupt change in diameter which occurs in the cylindrical expansion portion 32 results in a further radial expansion of the shot column. The instant that the shot column passes from the transitional portion 34 into the expansion portion 32 the escaping gases of explosion violently intermix with the pellets which comprises the shot column causing pellets to effect the flight of adjacent pellets. Additional turbulence is produced near the periphery of the shot column by the gases of explosion which escape from the muzzle of the barrel assembly 10 with the shot column. The net result is an opening of the shot pattern to a diameter greater than that which is typical in the shotgun art, thereby enhancing the short range effectiveness of the firearm.

The compensating slots 36, 36 function to hold the muzzle down when the gun is fired, in a manner well known in the firearm art, and also serve to release some gases of explosion thereby reducing the quantity of gas vented at the muzzle.

A barrel assembly of the type hereinbefore described will generally produce a shot pattern in the range of 10 to 16 inches in diameter at a distance of approximately 10 to 14 feet from its muzzle. Thus, the short range hit probability is substantially improved.

Figure 3:
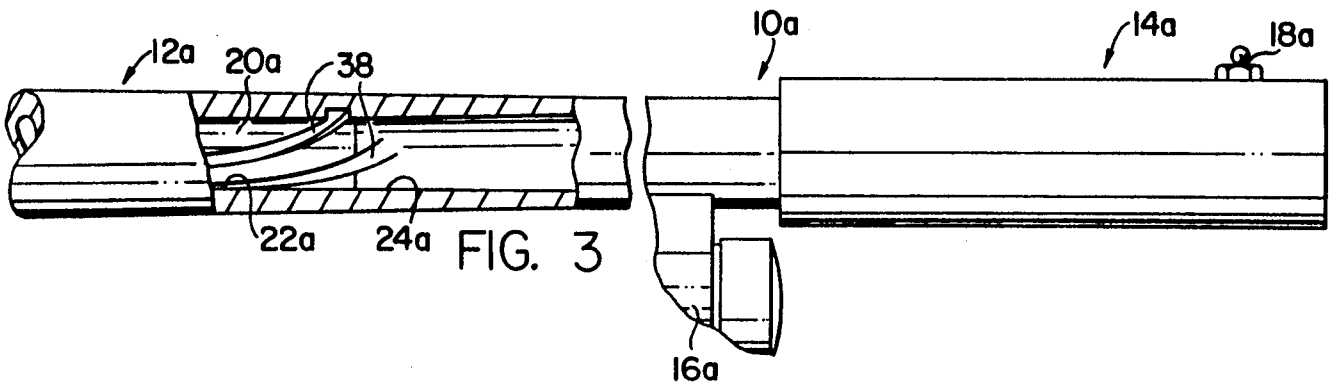
FIG. 3 is similar to FIG. 2 but shows another embodiment of the invention.

Further short range radial enlargement of the shot pattern may be affected by the provision of conventional rifling within the cylindrical portion of the bore and a further embodiment of the invention which includes such rifling is illustrated in FIG. 3 wherein the barrel assembly is indicated at 10*a*.

The barrel assembly 10*a* includes a barrel 12*a* which has a bore 20*a*. As in the previously described embodiment 10 the bore 20*a* has a cylindrical portion 22*a* and a tapered portion 24*a*. However the cylindrical portion 22*a* includes conventional rifling 38 defined by lands and grooves, as is well known in the firearm art. The rifling extends for at least a short distance into the tapered portion and terminates at a point where the radius of the conical portion is substantially equal to the radius of the bottom of the grooves.

The net effect of the rifling 38 the conically tapered portion 24 and the barrel extension 14*a* upon a shot column is to enlarge the short range pattern. It has been found that the aforesaid combination is capable of producing a short pattern as large as 22 inches in diameter at a distance approximately 10 to 14 feet from the muzzle.

I claim:

1. A shotgun barrel assembly comprising an axially elongate barrel having a front end and a rear end, a barrel extension mounted in fixed position at said front end, said barrel having a shell chamber in said rear end and an axially forwardly extending gun bore coaxially aligned and communicating with said shell chamber and opening through said front end, said gun bore including a first generally cylindrical portion having a first diameter and extending forwardly of said shell chamber, and a conically tapered forwardly diverging portion extending from the said cylindrical portion and terminating at said front end, said conically tapered portion having a second diameter at said front end and an axial length at least equal to eight times said first diameter, said barrel extension defining a bore extension coaxially aligned with said gun bore and including a cylindrical expansion portion having a third diameter larger than said first diameter, said bore extension defining a generally cylindrical transitional portion disposed between said front end and said expansion portion, said transitional portion having a fourth diameter substantially equal to said second diameter.

2. A shotgun barrel assembly as set forth in claim 1 wherein said conical tapered portion has an axial length substantially equal to ten times said first diameter.

3. A shotgun barrel assembly as set forth in claim 1 wherein said barrel extension defines a plurality of compensating slots wholly disposed to one side of an axial plane containing the axis of said bore, said compensating slots being rearwardly and outwardly inclined relative to said axis of said bore.

4. A shotgun barrel assembly as set forth in claim 1 including rifling defined by lands and grooves formed in said cylindrical portion.

5. A shotgun barrel assembly as set forth in claim 4 wherein said rifling extends into and terminates within said conically tapered portion in axially spaced relation to said front end.

6. A shotgun barrel assembly comprising an axially elongate barrel having a front end and a rear end, a shell chamber in said rear end, and an axially forwardly extending bore coaxially aligned and communicating with said shell chamber and opening through said front end, said gun bore including a first cylindrical portion having a first diameter and extending forwardly of said shell chamber and a conically tapered portion forwardly diverging from said first cylindrical portion to a second diameter, and a barrel extension mounted in fixed position on said front end and defining a bore extension coaxially aligned with said gun bore, said bore extension including a cylindrical expansion portion having a third diameter larger than said second diameter, said bore extension including a generally cylindrical transitional portion disposed between said front end and said expansion portion and having a forth diameter substantially equal to said second diameter.

7. A shotgun barrel assembly as set forth in claim 6 wherein said conically tapered portion has an axial length at least equal to eight times said first diameter.

8. A shotgun barrel assembly as set forth in claim 6 wherein said conically tapered portion has an axial length substantially equal to ten times said first diameter.

9. A shotgun barrel assembly as set forth in claim 6 including a plurality of compensating slots opening upwardly through said barrel extension and communicating with said bore extension.

10. A shotgun barrel assembly as set forth in claim 9 wherein said compensating slots are substantially parallel to each other.

11. A shotgun barrel assembly as set forth in claim 9 wherein said compensating slots are further characterized as upwardly and rearwardly inclined slots.

12. A shotgun barrel assembly as set forth in claim 9 wherein said compensating slots are disposed to one side of a diametric plane passing through an axis of the bore.

13. A shotgun barrel assembly as set forth in claim 6 including rifling defined by lands and grooves formed in said first cylindrical portion.

14. A shotgun barrel assembly as set forth in claim 13 wherein said rifling extends into said conically tapered portion and terminates therein.

15. A shotgun barrel assembly as set forth in claim 14 wherein said rifling terminates in axially spaced relation to said front end.

* * * * *